US005653084A

United States Patent [19]

Mueller

[11] Patent Number: 5,653,084

[45] Date of Patent: Aug. 5, 1997

[54] CARTON PACKING APPARATUS

[75] Inventor: Rolf Mueller, Mehring, Germany

[73] Assignee: Riverwood International Corporation, Atlanta, Ga.

[21] Appl. No.: 535,094

[22] PCT Filed: May 13, 1994

[86] PCT No.: PCT/GB94/01032

§ 371 Date: Dec. 8, 1995

§ 102(e) Date: Dec. 8, 1995

[87] PCT Pub. No.: WO94/26593

PCT Pub. Date: Nov. 24, 1994

[30] Foreign Application Priority Data

May 14, 1993 [GB] United Kingdom ..... 9309915

[51] Int. Cl.[6] ..... B65B 21/24; B65B 27/04

[52] U.S. Cl. ..... 53/48.7; 53/48.8

[58] Field of Search ..... 53/398, 48.7, 48.8, 53/48.9, 387.2

[56] References Cited

U.S. PATENT DOCUMENTS

| | | | |
|---|---|---|---|
| 26,851 | 4/1860 | Gentry . | |
| 3,295,291 | 1/1967 | Wood . | |
| 3,701,231 | 10/1972 | Standley | 53/48.9 |
| 4,285,185 | 8/1981 | Collura et al. | 53/48.7 |
| 4,554,778 | 11/1985 | Calvert | 53/48.7 X |
| 4,612,753 | 9/1986 | Taylor et al. | 53/48.9 X |
| 4,970,843 | 11/1990 | Louret et al. | 53/48.9 X |

FOREIGN PATENT DOCUMENTS 1259764 of 1918 Germany .

*Primary Examiner*—Horace M. Culver
*Attorney, Agent, or Firm*—Isaf, Vaughan & Kerr

[57] ABSTRACT

A carton packaging apparatus for use in wrapping open-ended sleeve type carton blanks around a pre-formed group of articles being moved along a path of travel through a packaging machine as disclosed. The apparatus includes a series of spaced guide members (30) which move along the path of travel and are adapted to engage one of the side panels (12, 13) of a successive series of carton blanks (10) being moved along the path of travel. The guide members are spaced so as to engage the leading edge and trailing edge of each one of the paperboard blanks as they are advanced along the path of the travel. Each guide member has an engagement element (35) which has an elongated link (36) with a foot (37) formed at one end, the other end of the link being pivotally fastened to the guide member. Each of the engagement elements moves with its respective guide member as a pin (38) projecting from the link is received within a groove (39) formed as a part of the apparatus for movement of the link, and thus the foot, relative to the movement of the guide member along the path of the travel for urging a trailing tuck panel of the carton blank into a position adjacent the side panel of the carton blank as the carton blank is being wrapped about the pre-formed group of articles. The apparatus is also provided with at least one guide wall (41) positioned with respect to the path of travel for guiding the side panels of the carton blank downward and about the group of articles, and a rotating wheel (42) also adapted to fold the sides of the carton blank about the pre-formed group of articles.

10 Claims, 6 Drawing Sheets

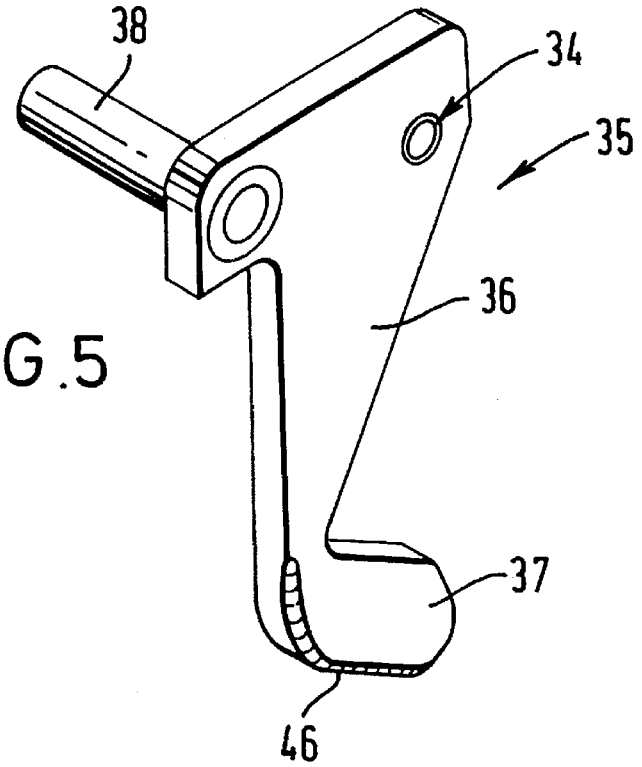
FIG.5
FIG.6
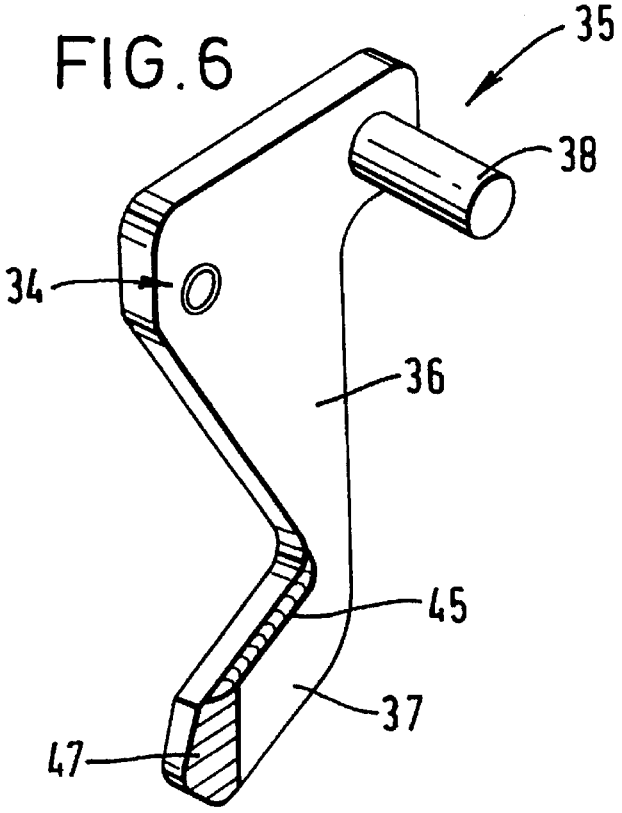

CARTON PACKING APPARATUS

BACKGROUND OF THE INVENTION

This invention relates to carton packing apparatus.

SUMMARY OF THE INVENTION

According to a first aspect of the present invention there is an apparatus is provided for use with a machine for packing cartons, each carton being formed from a blank having a first panel hingedly connected at opposite edges to respective second panels. The apparatus includes a series of spaced guide members adapted for travel in an endless path, the distance between the guide members being such that the first panel of successive blanks is engaged between successive guide members in the region of the hinge lines between the second panels and said first panel.

Preferably said first panel is a side panel and said second panels are end panels, the side panel being hingedly attached to a top panel which in use of the apparatus is held against movement relative to the contents of the carton. A further preferred feature is that a second series of guide members is provided for a second side panel on the opposite side of the top panel.

According to a second aspect of the present invention there is provided, an apparatus for use with a machine for packing cartons, each carton being formed from a blank having a top panel hingedly connected at opposite edges to first and second side panels, each side panel being is connected to a base panel, which blank is wrapped around the contents of the carton and the base panels secured. A gusset arrangement is provided at each open end between each side panel and the top panel and/or the base panel, each gusset arrangement comprising a tuck panel hingedly connected to the side panel and to one or more gusset panels, which in turn is/are connected to the top panel and/or the base panel. The second aspect of the invention includes a series of spaced guide members adapted for travel in an endless path, the distance between the guide members being such that the first side panels of successive blanks are engaged between successive guide members whilst the top panel is held against movement relative to said contents, each side panel being engaged in the region of the hinge lines between the tuck panels and the first side panels, at least one guide member for each first side panel being associated with an engagement member which is movable relative to said one guide member so as to engage the tuck flap associated with said one guide member so as to urge the tuck flap towards a position lying adjacent the first side panel.

Preferably each guide member is adapted to constitute a rear guide for one side panel and a front guide for a following side panel and the engagement member engages the rearmost tuck flap associated with the side panel.

In a preferred arrangement said engagement member comprises a link member terminating in a foot, said link member being pivotally connected to said one guide member such that the foot can move forward of the guide member to engage the tuck flap. Said link member and the foot lie between said one guide member and the contents, adjacent said one guide member.

A further preferred feature is that the leading edge of the foot adjacent the guide member is chamfered.

Conveniently the link member has a pin which engages in a groove thereby determining the orientation of the pin relative to said one guide member throughout its path and the groove is shaped so as to project the foot once the side panel is engaged between the guide members.

In a preferred embodiment the foremost tuck flap associated with the side panel engages a stationary guide wall as the blank and contents advances along the packing line, said guide wall urging said foremost flap back towards a position lying against the side panel.

An additional feature is that a vertical rotating wheel is provided just outwardly of the path of the guide members, which wheel supports the side panel as the foremost tuck panel engages the stationary guide surface. Preferably the wheel has equispaced segments of its circumference removed corresponding to the locations of the guide members.

In preferred applications the apparatus comprises an identical arrangement for the second side panels.

An embodiment of the present invention will now be described in more detail. The description makes reference to the accompanying diagrammatic drawings.

BRIEF DESCRIPTION OF THE DRAWINGS

FIG. 5 shows a close-up, perspective view from one side of an engagement element shown in FIGS. 2, 3 and 4, and FIG. 6 is a close-up perspective view from the other side of the engagement element shown in FIG. 5.

DETAILED DESCRIPTION

Figure 1A:
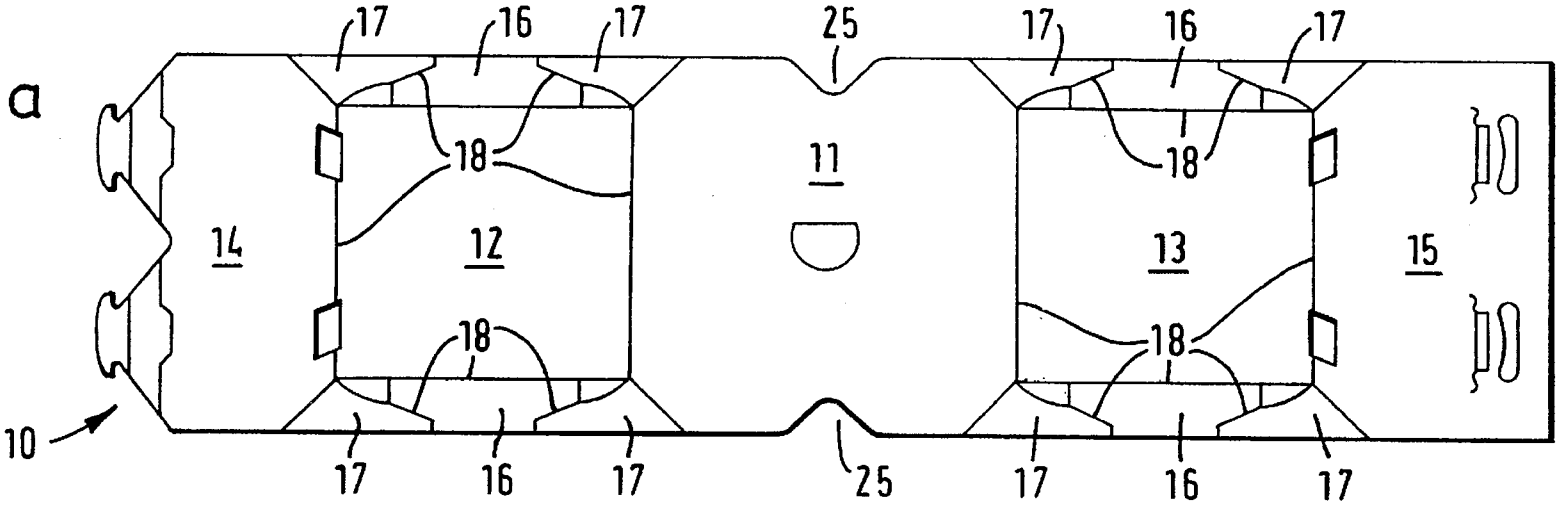
FIGS. 1*a*, 1*b*, 1*c* and 1*d* show examples of the types of carton blank which may be used with the apparatus of the present invention.
Figure 1B:
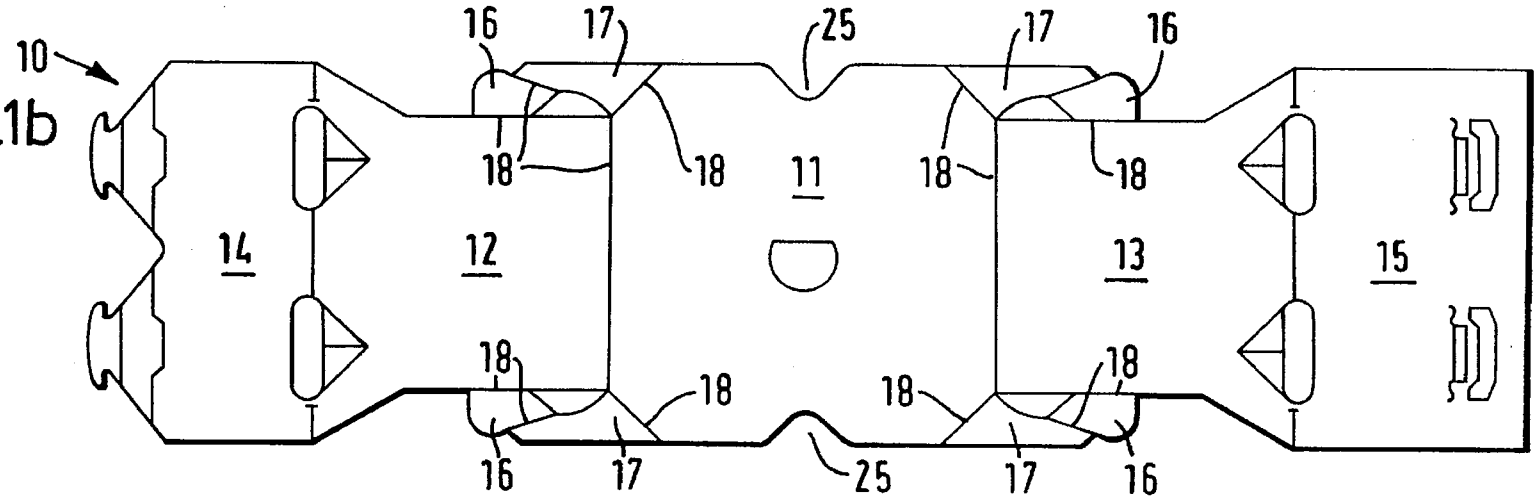
Figure 1C:
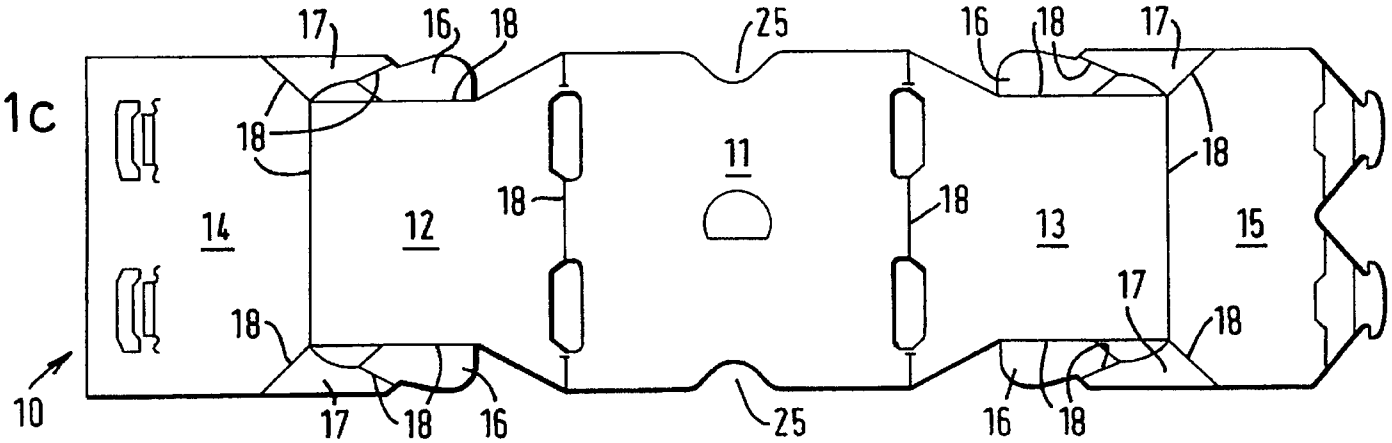

In FIGS. 1*a*, 1*b* and 1*c* there are shown blanks 10 having a top panel 11, first and second side panels 12, 13 and base panels 14, 15. The blanks also show gusset arrangements comprising tuck panels 16 and gusset panels 17. In use, the tuck panels 16 lie generally against the respective side panels 12, 13 whilst the gusset panels 17 serve to obstruct the otherwise open ends of the sleeve-like carton. The various panels 11 to 17 are connected along hinge lines 18.

The following briefly points out the differences between the illustrated examples of blanks for "gussetted cartons". FIG. 1*a* has a single tuck panel 16 associated with a pair of gusset panels 17 attached to both top and base panels 11, 14, 15. FIG. 1*b* has a single tuck panel 16 and gusset panel 17 associated with the top panel 11 whilst FIG. 1*c* has a single tuck panel 16 and gusset panel 17 associated with the base panels 14, 15.

All of the above examples, together with other gussetted cartons are adapted for use with the following apparatus although positional and dimensional alterations may be required.

Figure 2:
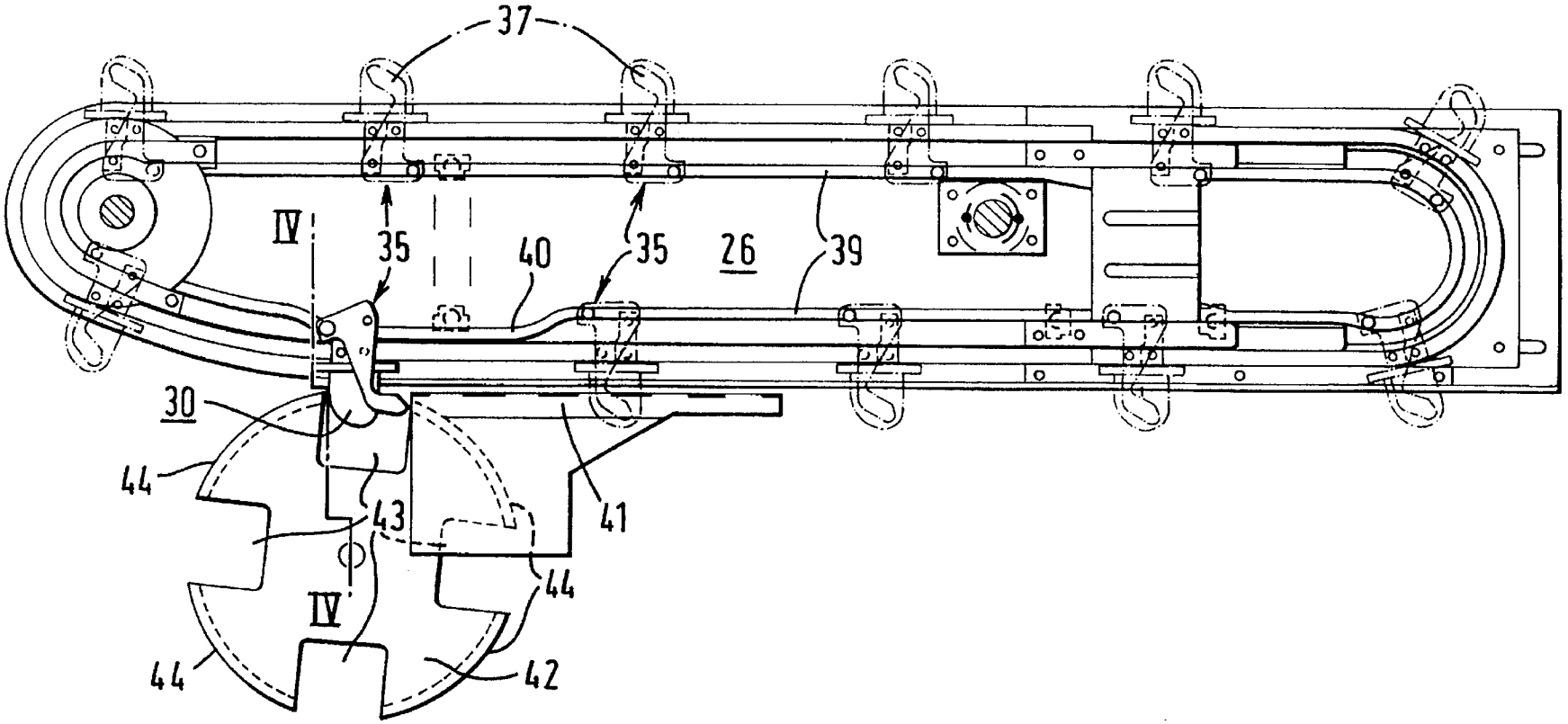
FIG. 2 shows a side view facing in the direction of arrow A of FIG. 4 of an apparatus according to the present invention.
Figure 3:
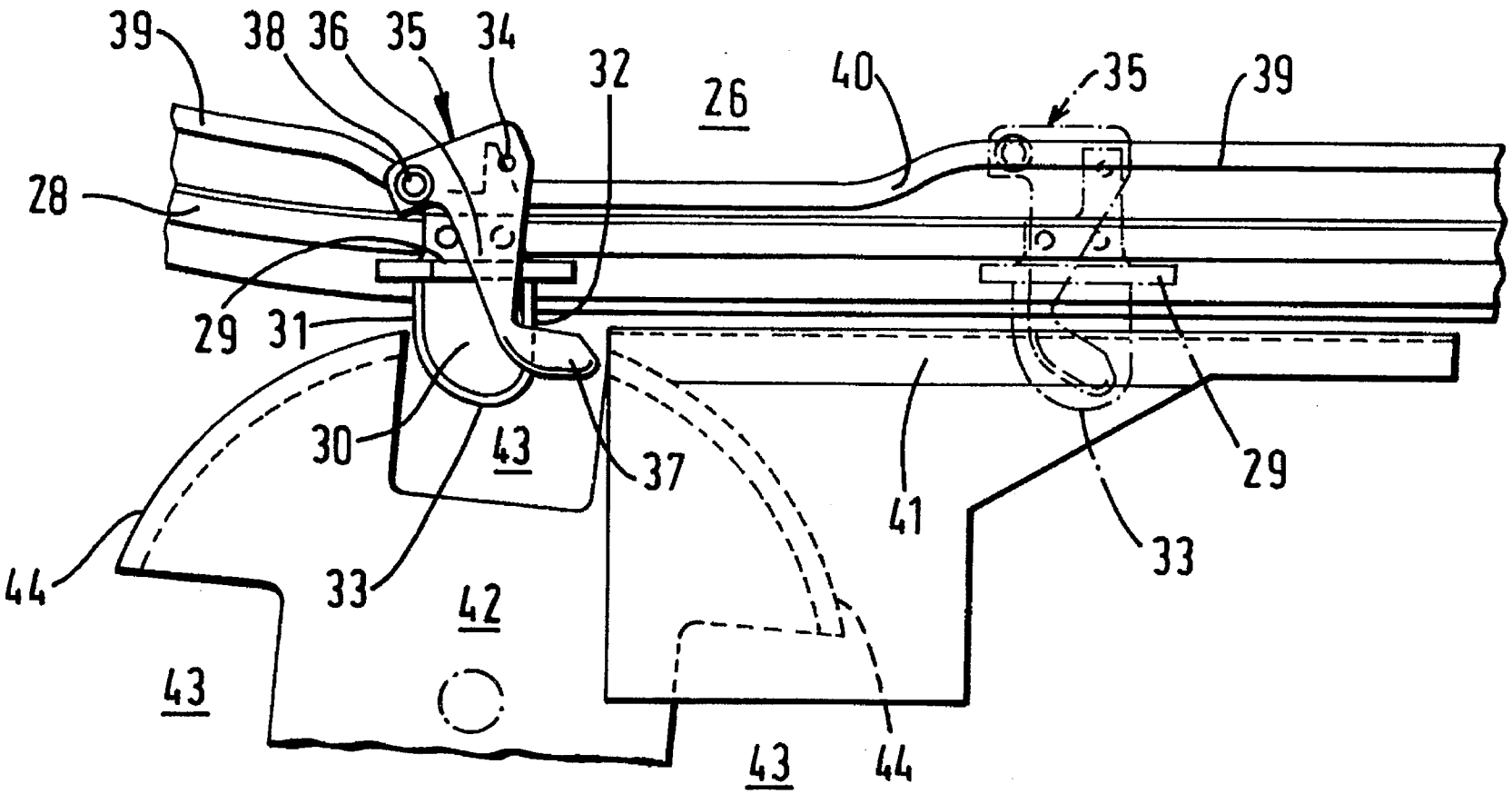
FIG. 3 shows a close up view of part of the FIG. 2 apparatus.
Figure 4:
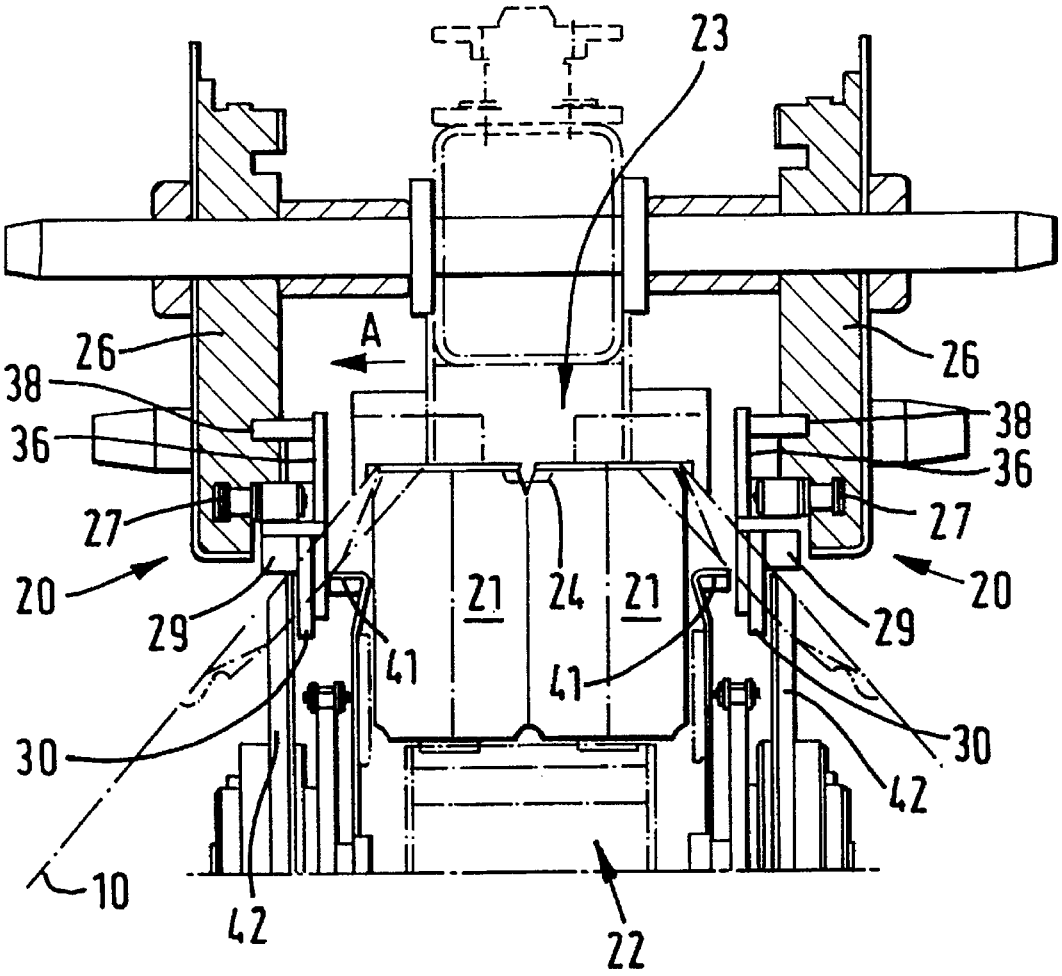
FIG. 4 is a cross section along line IV—IV of FIG. 2.

FIGS. 2 to 4 show apparatus 20 for use in a machine used for wrapping a blank 10 of the type shown in FIG. 1*a* above around a plurality of cans 21. Not all of the actions of the machine will be described for simplicity. The cans 21 are conveyed two abreast along the lengthwise axis of the machine by lower conveyor 22. The blanks 10 are automatically fed on to the cans 21 and are held against the cans 21 by an upper conveyor 23 which is run at the same speed as the lower conveyor 22 and which has registration lugs 24 for engagement with associated recesses 25 in the blanks 10. The side panels 12, 13 and other dependent panels hang down at an angle from the top panel 11 ready to be wrapped around the cans 21.

Disposed on either side of the lengthwise axis of the machine is the apparatus 20. The operation of the apparatus 20 on each side is identical and so only one side will be described. The apparatus 20 comprises a guide block 26 which carries an endless chain 27 in a chain groove 28, the chain being driven at the same speed as the upper and lower conveyors 22, 23. Equispaced along the chain 27 are attached guide elements 29 carrying guide members 30 in the form of lugs each having a rear guide surface 31 and a forward guide surface 32. As the cans 21 and blanks 10 are fed along the axis of the machine the guide members 30 engage the side panel 12 of the successive blanks 10. Each guide member 30 engages the rear edge of first side panel 12 and the forward edge of a second, following side panel 12 by virtue of forward guide surface 32 and rear guide surface 31 respectively.

The distance between the forward guide surface 32 of one guide member 30 and the rear guide surface 31 of the leading guide member 30 is generally identical to the width of the side panel 12 between the hinge lines 18 connecting the tuck panels 16 to the side panel 12. The guide members have a curved lower edge 33 which engages the tuck panels 16 of the blank 10 and urges the tuck panels 16 inwards before the guide surfaces 31, 32 engage the side panel 12 at the said hinge lines 18.

Attached to each guide element 29 on pivot 34 is an engagement element 35 comprising a link 36 terminating in a foot 37. As is more clearly shown in FIGS. 5 and 6 the foot 37 is provided with a rounded top outer edge 45, a rounded lower inner edge 46 and a chamfered toe portion 47 on its inner side. The chamfer portion 47 extends generally vertically when the foot 37 is in its retracted position. These features assist in the correct operation of the engagement element 35. The element 35 carries a pin 38 which is received in a second groove 39 in the guide block 26. For most of the endless path of the guide elements 29, the links 36 lie adjacent the associated guide members 30, on the side nearer the central lengthwise axis of the machine. However the second groove 39 has a misaligned portion 40 which causes the links 36 to pivot relative to the guide elements 29. This in turn results in the foot 37 projecting forwards of the forward guide surface 32 of the guide member 30.

This movement of the foot 37 is timed to occur after the side panel 12 is engaged between successive guide members 30. The result of this foot movement is to urge the rear tuck panel 16 into engagement with the inside surface of the side panel 12 of the blank 10.

The apparatus also provides a guide wall 41 which engages the leading tuck panel 16 of an approaching blank 10 and folds this tuck panel 16 against the inside surface of the side panel 12. The location of the guide wall 41 relative to the misaligned portion 40 of the second guide groove 39 is such that the rear tuck panel 16 of an approaching blank 10 is urged towards its side panel sufficiently for the rear tuck panel 16 to be retained in its tucked position by said guide wall 41.

In such a position it is possible for the machine to hinge the side panels 12, 13 inwards so that the tuck panels 16 are retained in position by the cans 21. The machine can then secure the blank in any suitable manner, for example interlocking formations or adhesive.

Also provided in the apparatus is a rotating wheel 42 having equispaced sections 43 removed from its circumference. The remaining sections 44 of the circumference are of such a length that rotation of the wheel 42 results in the guide members 30 and elements 35 being aligned with the sections 43. The remaining sections 44 support the side panel 12 as the guide members engage the side panels and as the leading tuck panel 16 is being engaged by the guide wall 41. The support provided by the wheel 42 prevents the side panel 12 from buckling undesirably during this action and ensures the correct hinging of the tuck panels relative to the side panels 12, 13.

Many alternatives are of course possible. For example the guide elements 29 and the engagement elements 35 need not be connected but could be driven separately. Such alternatives would be readily apparent to the skilled reader.

Figure 1D:
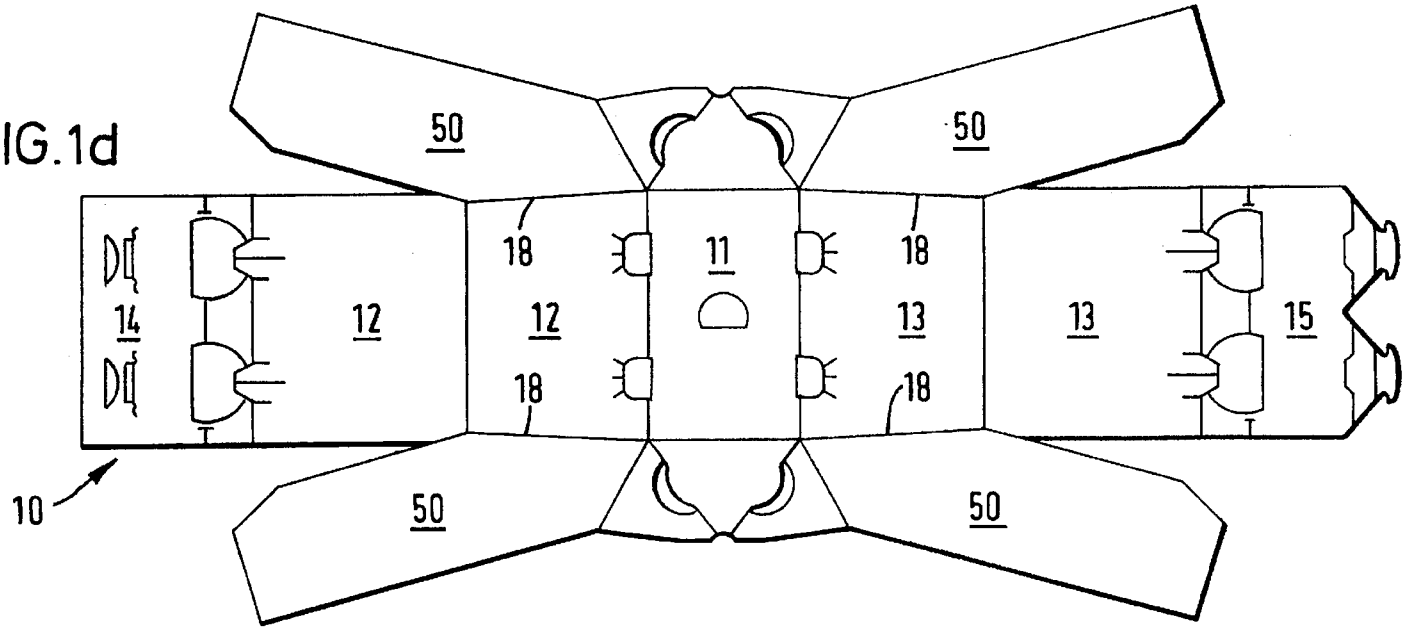

In some embodiments it is not even necessary to provide the engagement elements 35. With such embodiments it may only be necessary to fold a pair of panels relative to an intermediate panel. The blank 10 shown in FIG. 1*d* is an example of such an embodiment. With the FIG. 1*d* blank there are provided end panels 50 attached along hinge lines 18 to side panels 12, 13. As the top panel 11 of this blank 10 is fed on to its contents, the guide members 30 engage the end panels 50 and fold them about hinge lines 18 relative to the side panels so as to be generally perpendicular thereto. This is the general position of the end panels 50 in the finished carton.

The above arrangements are suitable with unpitched packing lines where successive products are in direct contact with each other. It can also be used with pitched packing lines where there are gaps between groups of products being packed. This is of course the case with the FIG. 1*d* blank where panels project beyond the forward and rear edges of the top and side panels.

The apparatus can of course be used for packing lines for any type of product including cans, bottles, tetrabricks.

While a preferred embodiment of the invention has been disclosed in the foregoing specification and drawings, it will be understood by those skilled in the art that variations and modifications thereof can be made without departure from the spirit and scope of the invention as set forth in the following claims.

I claim:

1. An apparatus for use with a packaging machine for wrapping open-ended sleeve type carton blanks around a pre-formed group of articles being advanced along a path of travel through the packaging machine, each carton blank being formed from a paperboard blank and having a top panel hingedly connected at opposite side edges to a first side panel and an opposed second side panel, each side panel being hingedly connected to a base panel, the carton blank being constructed and arranged to be wrapped around the pre-formed group of articles as the base panels are secured together, the carton blank also including a gusset arrangement at each open end of the carton blank and extending between each side panel and at least one of the top panel and the base panel of the carton blank, respectively, each gusset arrangement including a leading tuck panel and a trailing tuck panel, respectively, at each one of the ends of the carton blank and being hingedly connected to at least the first side panel and to at least one gusset panel, said at least one gusset panel also being hingedly connected to at least one of the top panel and the base panel, respectively, said apparatus comprising:

a series of spaced guide members constructed and arranged to travel along the path of travel, the distance between said spaced guide members being such that the first side panel of successive carton blanks is engaged between successive ones of said guide members as the top panel of each said carton blank is held by said apparatus in a fixed position on and with respect to each one of the pre-formed group of articles moving along the path of travel each one of the first side panels being engaged by one each of said guide member at the hinged connection between the tuck panels and the first side panel of each respective carton blank, each said guide member having an engagement member constructed and arranged to be movable relative to said guide member so as to urge the tuck panel engaged by each said guide member into a position adjacent the side panel.

2. The apparatus as claimed in claim 1 wherein each said guide member is sized and shaped as a rear guide for one of the side panels of a first carton blank and as a front guide for one of the side panels of a second successive carton blank.

3. The apparatus as claimed in claim 1 or 2 wherein said engagement member is constructed and arranged to engage the trailing tuck panel hingedly connected to the first side panel.

4. The apparatus as claimed in claim 1, wherein said engagement member of each said guide member comprises an elongated link member terminating at one of its ends in a foot, said link member being pivotally connected at the other of its ends to said guide member and being constructed and arranged so that the foot can move forward of the guide member to engage the trailing tuck panel.

5. The apparatus as claimed in claim 4 wherein said link member and the foot thereof are positioned between said guide member and the pre-formed group of articles being packaged.

6. The apparatus as claimed in 5 wherein said foot has a chamfered leading edge, said leading edge being positioned adjacent the guide member.

7. The apparatus as claimed in claim 6 wherein said link member has a pin, said pin being sized and shaped to engage a groove defined in said apparatus with respect to said guide members and extending along the path of travel, said groove being sized and shaped to determine the orientation of the pin relative to said guide members so as to project said foot forward as the first side panel is engaged between said spaced guide members.

8. The apparatus as claimed in claim 1 wherein the leading tuck panel engages a stationary guide wall positioned with respect to the path of travel as the carton blank advances along the path of travel, said guide wall being sized and shaped to urge the leading tuck panel back toward the first side panel.

9. The apparatus as claimed in claim 8 further comprising a vertically disposed rotating wheel positioned with respect to the carton blank as it moves along the path of travel outwardly of the guide members as said guide members advance along the path of travel, said wheel being sized and shaped to support the first side panel as the leading tuck panel engages said stationary guide wall.

10. The apparatus as claimed in claim 9 wherein said wheel has a radially and equally spaced series of openings defined in the circumference thereof, said opening corresponding to the spacing of said guide members for successively receiving said guide members therein as said guide members advance the carton blank along the path of travel.

* * * * *